US011344767B1

(12) United States Patent
Lagioia

(10) Patent No.: US 11,344,767 B1
(45) Date of Patent: May 31, 2022

(54) EXERCISE APPARATUS

(71) Applicant: Christopher Alan Lagioia, Naperville, IL (US)

(72) Inventor: Christopher Alan Lagioia, Naperville, IL (US)

( * ) Notice: Subject to any disclaimer, the term of this patent is extended or adjusted under 35 U.S.C. 154(b) by 0 days.

(21) Appl. No.: 16/992,326

(22) Filed: Aug. 13, 2020

Related U.S. Application Data

(63) Continuation-in-part of application No. 16/846,352, filed on Apr. 12, 2020.

(51) Int. Cl.
*A63B 21/00* (2006.01)
*A63B 21/002* (2006.01)

(52) U.S. Cl.
CPC ..... *A63B 21/4034* (2015.10); *A63B 21/002* (2013.01); *A63B 21/0004* (2013.01); *A63B 21/4035* (2015.10); *A63B 21/4049* (2015.10); *A63B 2208/0266* (2013.01)

(58) Field of Classification Search
CPC ..... A63B 22/14; A63B 22/16; A63B 22/18; A63B 22/20; A63B 21/0004; A63B 21/068; A63B 21/4015; A63B 26/003; A63B 69/3692; A61H 1/001; A61H 1/003; A61H 1/005; A61H 1/006; A61H 1/02; A61H 1/0237; A61H 1/0266; A61H 2015/0042; A61H 2015/0064; A61H 2201/0157; A61H 2201/1252; A61H 2201/1261; A61H 2201/164; A61H 2201/1661; A61H 2201/1671; A61H 2201/1673; A63F 9/26
USPC ..... 446/396; 473/279
See application file for complete search history.

(56) References Cited

U.S. PATENT DOCUMENTS

| | | | | | |
|---|---|---|---|---|---|
| 3,586,321 | A | | 6/1971 | Gehrke | |
| D241,863 | S | * | 10/1976 | Friedl | D21/689 |
| D247,323 | S | * | 2/1978 | Risberg | D21/412 |
| 4,601,469 | A | * | 7/1986 | Sasser, Jr. | A63B 22/16 482/146 |
| 4,613,131 | A | * | 9/1986 | Anderson | B63B 34/50 441/67 |

(Continued)

FOREIGN PATENT DOCUMENTS

JP 6552025 7/2019

OTHER PUBLICATIONS

NPL-5 BOSU Ball Exercises For Cyclists, Susan Grant Legacki, https://www.active.com/fitness/articles/5-bosu-ball-exercises-for-cyclists?page=3.

*Primary Examiner* — Nyca T Nguyen
*Assistant Examiner* — Zachary T Moore
(74) *Attorney, Agent, or Firm* — The Law Offices of Konrad Sherinian, LLC; Depeng Bi

(57) ABSTRACT

A new side plank exercise device is in the shape of a spherical cap or a cone. The side plank exercise device includes a front end that is circular or oval. The side plank exercise device also includes a rear end tapered from the front end. The rear end is a spherical cap. The front end has a flat or a cavitary surface. The front end also includes two recesses for receiving a left shoe and a right shoe. The two recesses are two inches deep and also uneven in depth. Each recess further incorporates a grip at its bottom. The grip includes protruding lines or spherical caps. The device further includes an edge at the front end that extends outwardly from the front end. The edge includes an attachment point with a crossbar and an attachment cavity receiving the crossbar.

20 Claims, 4 Drawing Sheets

(56) References Cited

U.S. PATENT DOCUMENTS

| | | | | |
|---|---|---|---|---|
| 5,048,823 | A * | 9/1991 | Bean | A63B 22/18 482/146 |
| 5,603,662 | A * | 2/1997 | Kreaman-Stern | A63B 22/18 472/40 |
| 6,019,712 | A | 2/2000 | Duncan | |
| 6,551,225 | B1 | 4/2003 | Romero | |
| 6,575,885 | B1 * | 6/2003 | Week | A63B 21/0004 482/148 |
| 7,008,359 | B2 * | 3/2006 | Fan | A63B 22/18 482/146 |
| 7,137,938 | B2 | 11/2006 | Gottlieb | |
| 7,833,145 | B2 * | 11/2010 | Ko | A63B 21/0552 482/142 |
| 8,105,218 | B1 | 1/2012 | Vayntraub | |
| 8,226,533 | B2 * | 7/2012 | Wessels | A63B 26/00 482/141 |
| 8,382,645 | B2 * | 2/2013 | Mylrea | A63B 22/20 482/79 |
| 8,444,532 | B1 * | 5/2013 | Barcena | A63B 21/023 482/51 |
| 8,678,985 | B2 * | 3/2014 | Mattox | A63B 21/0004 482/148 |
| 8,814,768 | B1 | 8/2014 | Yang et al. | |
| 9,320,940 | B2 | 4/2016 | Rainey | |
| 10,220,243 | B2 | 3/2019 | Koegel | |
| D870,828 | S | 12/2019 | Dicharry | |
| 10,940,354 | B2 * | 3/2021 | Oltorik Jr. | A63B 21/4043 |
| 2007/0298947 | A1 | 12/2007 | Eksteen | |
| 2009/0215596 | A1 * | 8/2009 | Obermaier | A63B 26/003 482/142 |
| 2013/0288866 | A1 * | 10/2013 | Rainey | A63B 22/18 482/146 |

* cited by examiner

EXERCISE APPARATUS

CROSS REFERENCE TO RELATED APPLICATIONS

This application is a continuation-in-part of co-pending U.S. patent application Ser. No. 16/846,352, entitled "EXERCISE APPARATUS," filed Apr. 12, 2020, which is hereby incorporated by reference in its entirety. This application also claims the benefit and priority of co-pending U.S. patent application Ser. No. 16/846,352, entitled "EXERCISE APPARATUS," filed Apr. 12, 2020, which is hereby incorporated by reference in its entirety.

FIELD OF THE DISCLOSURE

The present invention generally relates to a physical exercise apparatus, and more particularly relates to an exercise device for side plank exercise. More particularly still, this disclosure relates to a side plank exercise device that can also be used for balance exercise and stability exercise.

DESCRIPTION OF BACKGROUND

The side plank exercise is a very popular physical exercise. It strengthens the oblique abdominal muscles, adductor longus muscles, tensor fasciae latae muscles and other muscles. To perform the side plank exercise, a person starts on her/his side with the feet together and one forearm below the corresponding shoulder. She/he then contracts the core and raises the hips until the body is in a straight line from the head to the feet. The person then holds the position without letting the hips drop for a period of time and or cycles up and down while squeezing the oblique and abdominal muscles. She/he can also repeat the same routine on the other side. There are a variety of plank variations including elbow side plank, straight arm plank, plank twists, weighted plank twists etc.

However, the conventional style of side plank exercise has numerous drawbacks. For example, during the side plank exercise, the body, the arm and the floor form a triangle with one foot touching the floor. The triangle orientation puts less pressure on the oblique abdominal muscles and other muscles than when the feet are also raised above the floor. As another example, with the conventional style of side plank exercise, only one foot touches the floor and supports the performer's lower body while the other foot and leg are in a completely relaxed state. As yet another example, with the conventional style of side plank exercise, the foot touching the floor is completely still. In such a case, the performer loses the ability to strengthen additional muscles. Further still, stacking the feet or placing both feet on the ground can be awkward because they place stress on the feet and ankles and take the focus off the primary exercise. This is one of the primary reasons that individuals avoid side planks in the first place.

Accordingly, there is a need for a new portable side plank exercise apparatus that allows the performer to put her/his oblique muscles under more stress and thus improves the efficiency of the side plank exercise. The side plank exercise apparatus takes pressure off of the feet and ankles enabling the individual to focus more effort on the obliques for longer. The new side plank exercise device also allows both feet and legs to support the performer's body weight. In addition, the new side plank exercise allows the performer to twist her/his body during the side plank exercise and thus strengthens more muscles than the conventional side plank exercise.

Furthermore, the new portable side plank exercise device allows the performer to quickly and easily switch sides by rotation. Moreover, the new side plank exercise device serves multiple types of exercises, such as balance exercise and stability exercise.

SUMMARY OF THE DISCLOSURE

Generally speaking, pursuant to the various embodiments, the present disclosure provides a side plank exercise system. The new side plank exercise device includes a front end having a front surface and a pair of recesses extending away from the front surface and adapted to receive a left side shoe and a right side shoe respectively. The front surface has a front edge enclosing the pair of recesses. The front edge is circular or oval. The side plank exercise device also includes a rear end extended away from the front end. The rear end is tapered from the front end. The front surface is a flat surface or a cavitary surface; and the rear end is in the shape of a spherical cap. The side plank exercise device is in the shape of a spherical cap or a cone. Each recess within the pair of recesses incorporates a grip at a bottom surface of the recess. The grip includes a set of protruding lines or a set of protruding spherical caps. Each recess within the pair of recesses has a depth of two inches. In addition, each recess within the pair of recesses is uneven in depth. The side plank exercise device can also be in the shape of a hemisphere.

Further in accordance with the present teachings is a side plank exercise device incorporating a front end having a front surface and a pair of recesses extending away from the front surface and adapted to receive a left side shoe and a right side shoe respectively. The front surface has a front edge enclosing the pair of recesses. The front edge is circular or oval. The side plank exercise device also includes a rear end extended away from the front end wherein the side plank exercise device is in the shape of a frustum or a cylinder. The front surface is a flat surface or a cavitary surface. Each recess within the pair of recesses incorporates a grip at a bottom surface of the recess. The grip includes a set of protruding lines or a set of protruding spherical caps. Each recess within the pair of recesses has a depth of two inches. In addition, each recess within the pair of recesses is uneven in depth. In a further implementation, the side plank exercise device includes an edge extending away from the front end outwardly. The extension is in horizontal orientation. In addition, the side plank exercise device incorporates an attachment point on the edge. The attachment point includes a crossbar in the edge and an attachment cavity receiving the crossbar and exposing two holes on the surface of the edge.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

A person of ordinary skills in the art will appreciate that elements of the figures above are illustrated for simplicity and clarity, and are not necessarily drawn to scale. The dimensions of some elements in the figures may have been exaggerated relative to other elements to help understanding of the present teachings. Furthermore, a particular order in which certain elements, parts, components, modules, steps, actions, events and/or processes are described or illustrated may not be actually required. A person of ordinary skills in the art will appreciate that, for the purpose of simplicity and clarity of illustration, some commonly known and well-understood elements that are useful and/or necessary in a commercially feasible embodiment may not be depicted in order to provide a clear view of various embodiments in accordance with the present teachings.

DETAILED DESCRIPTION

Figure 1:
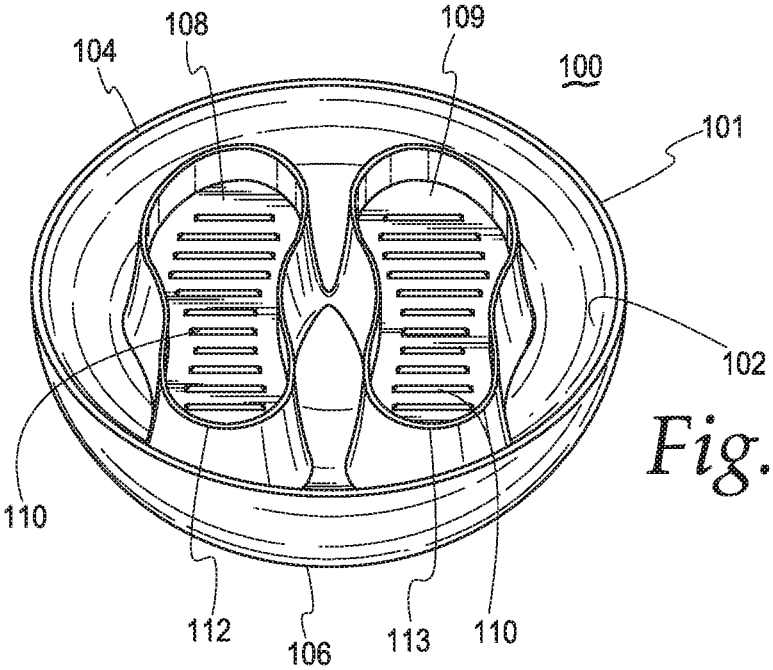
FIG. 1 is an illustrative diagram showing a front perspective view of a new side plank exercise apparatus in accordance with this disclosure.

Turning to the Figures and to FIG. 1 in particular, a front perspective view of a new side plank exercise device is shown and generally indicated at 100. The new side plank exercise device 100 incorporates a front end 101 and a rear end 106. The rear end 106 projects and extends away from the front end 101. The front end 101 includes a front surface 102 that has a front edge 104. The front end 101 further incorporates a pair of recesses 108 and 109. The recesses 108-109 merge with the front surface 102 at the contours 112 and 113 respectively. As used herein, the front edge 104 is said to enclose the recesses 108-109.

The new side plank exercise device 100 is made of, for example, plastics or rigid rubber. In one implementation, it is made of molded plastic that is infused with fiberglass. In the illustrative embodiment, the front surface 102 is not a flat surface and forms a cavity toward the rear end 106. The cavity reduces the weight of the new side plank exercise device 100, and saves materials to construct the same. In such a case, the front surface 102 is said to be a cavitary surface. The front edge 104 and the contours 112-113 are parallel or substantially parallel to each other. In a further implementation, the front edge 104 and the contours 112-113 are in the same plane and approximately the same plane.

In the illustrative embodiment, the side plank exercise device 100 is in the shape of a partial sphere (i.e., a spherical cap). As used herein, a spherical cap can be a portion of a hemisphere (meaning less than a hemisphere), a hemisphere, or more than a hemisphere. Furthermore, as used herein, the side plank exercise device 100 is said to be spherical and tapered. In addition, the rear end 106 is said to be tapered from the front end 101. In the illustrative embodiment, the front end 101 is circular.

The recesses 108-109 are adapted to receive a pair of shoes of a user of the side plank exercise device 100. The recess 108 is configured for receiving the left side shoe while the recess 109 is configured for receiving the right side shoe. The recesses 108-109 are also adapted to receive two bare feet or two feet with a pair of socks on. In one implementation, the recesses 108-109 are configured in the general shape of male shoes, such as sneakers and running shoes. In an alternative embodiment, the recesses 108-109 are configured in the general shape of female shoes, such as sneakers and running shoes.

In one embodiment, the depth of the recesses 108-109 is two or approximately two inches. In either case, the depth is said to be two inches. In a further implementation, to increase the area of contact between the shoes and the bottom surfaces of the recesses 108-109, the depth of the front end of the bottom surface of each of the recesses 108-109 is configured to be gradually smaller toward the front tip. Furthermore, the depth of the inside middle area of each of the recesses 108-109 corresponding to the medial arch of a foot is also configured smaller than two inches. In such a case, the recesses 108-109 are said to match the natural shapes of exercise shoes (such as running shoes and sneakers) and are uneven in depth.

Figure 3:
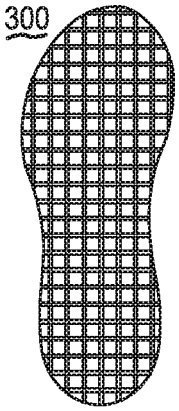
FIG. 3 is an illustrative diagram showing a top view of a grip of a new side plank exercise apparatus in accordance with this disclosure.

The recesses 108-109 each can further incorporate a grip 110 for improving the gripping force between the shoes and the side plank exercise device 100. The grip 110 includes a set of protruding lines. The grip 110 can also be constructed in different shapes. As shown in FIG. 3, a grip 300 includes a set of protruding crossing lines.

Figure 2:
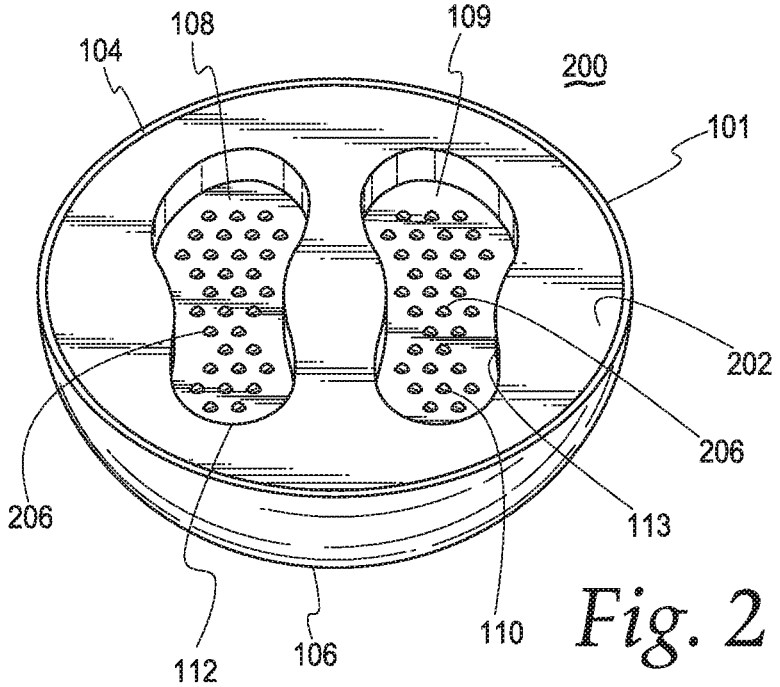
FIG. 2 is an illustrative diagram showing a front perspective view of a new side plank exercise apparatus in accordance with this disclosure.

Referring now to FIG. 2, a front perspective view of a different embodiment of the new side plank exercise device 100 is shown and generally indicated at 200. The new side plank exercise device 200 incorporates two grips 206 that each include a set of protruding spherical caps. Different from the side plank exercise device 100, the new side plank exercise device 200 includes a front surface 202 that is flat.

Figure 4:
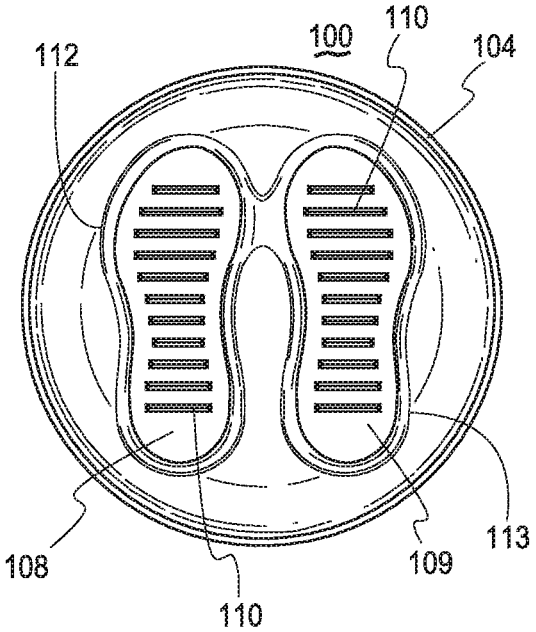
FIG. 4 is an illustrative diagram showing a top view of a new side plank exercise apparatus in accordance with this disclosure.
Figure 5:
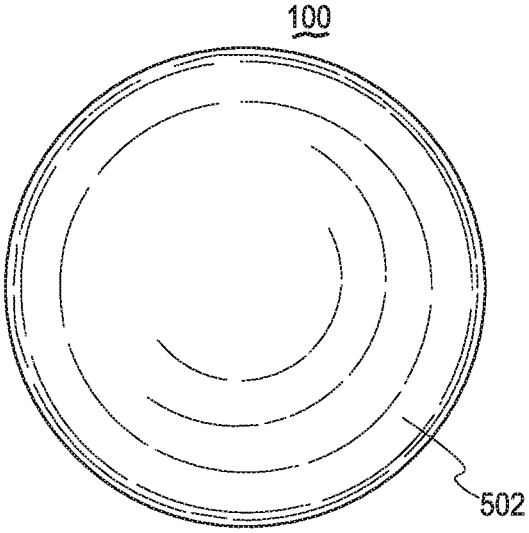
FIG. 5 is an illustrative diagram showing a bottom view of a new side plank exercise apparatus in accordance with this disclosure.
Figure 6:
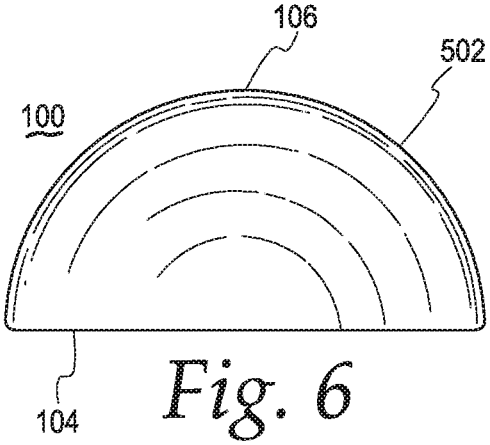
FIG. 6 is an illustrative diagram showing a side view of a new side plank exercise apparatus in accordance with this disclosure.

FIG. 4 shows a top view of the side plank exercise device 100. FIG. 5 shows a bottom view of the side plank exercise device 100. A side view of the side plank exercise device 100 is shown in FIG. 6. The side surface of the side plank exercise device 100 is indicated at 502.

Figure 7:
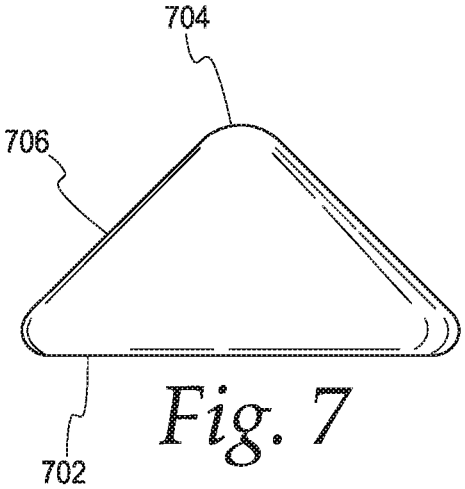
FIG. 7 is an illustrative diagram showing a side view of a new side plank exercise apparatus in accordance with this disclosure.

A different embodiment of the side plank exercise device 100 is shown in FIG. 7 and generally indicated at 700. The shape of the new side plank exercise device 700 is generally a cone with the front surface edge indicated at 702, the rear end indicated at 704, and the side surface indicated 706. The side plank exercise device 700 can also be constructed in other shapes with its diameter gradually lessens toward the rear end 704. As used herein, the side plank exercise device 700 is said to be tapered and in a tapered shape. In addition, the rear end 704 is said to be tapered from the front end 702. In the illustrative embodiment, the front end 702 is circular.

Figure 8:
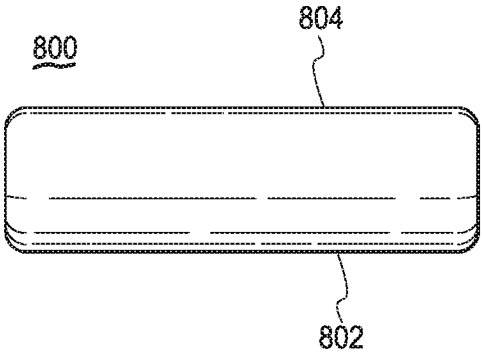
FIG. 8 is an illustrative diagram showing a side view of a new side plank exercise apparatus in accordance with this disclosure.

Another different embodiment of the side plank exercise device 100 is shown in FIG. 8 and generally indicated at 800. The shape of the new side plank exercise device 800 is generally cylindrical with the front surface edge indicated at 702, and the rear end indicated at 804.

Figure 9:
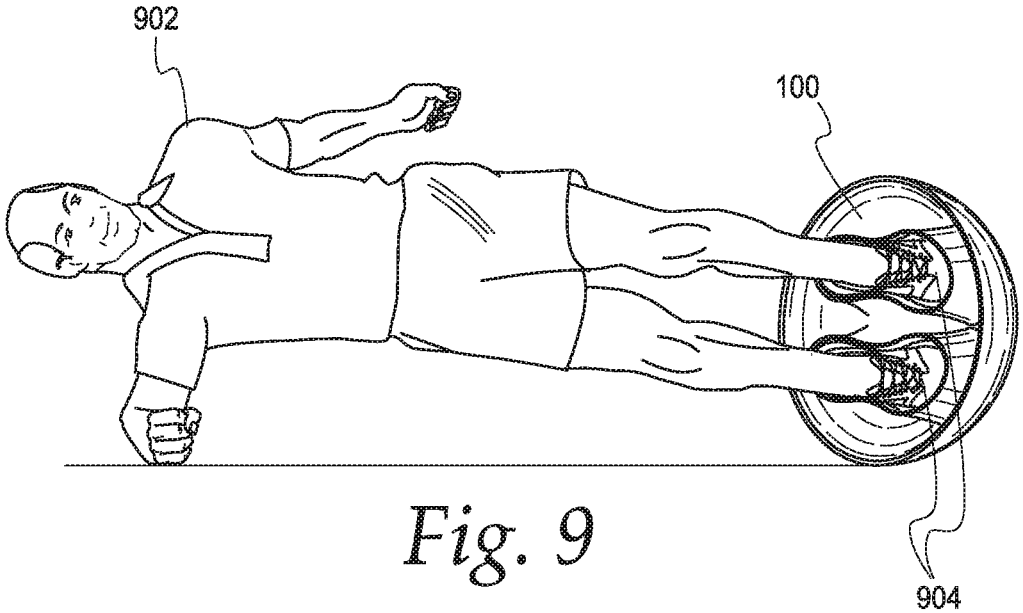
FIG. 9 is an illustrative diagram showing a user doing side plank exercise using a new side plank exercise apparatus in accordance with this disclosure.

To use the side plank exercise device 100, 200, 700 or 800 for a side plank exercise, a user first places her/his feet and shoes into the recesses 108-109, and then performs other steps of a conventional side plank exercise. A perspective view of the user and the side plank exercise device 100 is shown in FIG. 9. The user is indicated at 902 while the shoes are indicated at 904.

With the shoes 904 disposed inside the recesses 108-109, they are above the exercise floor, and thus cause more stress on oblique abdominal muscles and other muscles. The increased stress improves the efficiency of the side plank exercise. In addition, the user 902 can operate her/his feet to rotate the side plank exercise device 100 such that the shoes 904 are flat or tilted at an angle to the exercise floor. The tilting further allows the user 904 to strengthen muscles that are not exercised or not greatly exercised in conventional side plank exercises. In addition, the tilting of her/his feet improves strengthening of oblique abdominal muscles, adductor longus muscles, tensor fasciae latae muscles and other muscles that are targeted in conventional side plank exercises. To switch from left to right or right to left, the user 902 simply rotates the side plank exercise device 100 by about 180 degrees.

The side plank exercise devices 100, 200 and 700 can also be operated for balance and stability exercises. To do so, the user 902 places the side plank exercise device 100 on an exercise floor with its rear end 106 making contact with the exercise floor, and steps into the two recesses 108-109. The rear ends 106 and 704 each are in a spherical shape to provide three hundred sixty degrees of freedom of movement.

Figure 12:
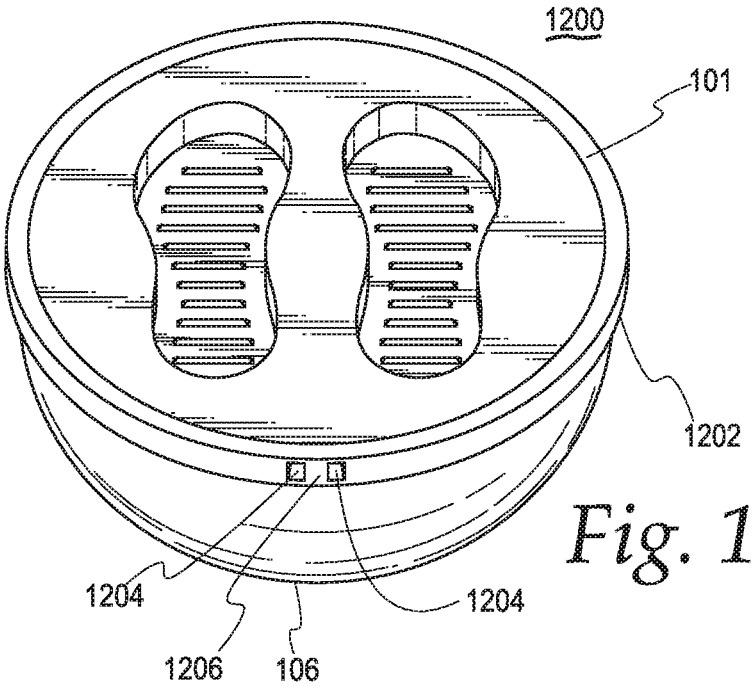
FIG. 12 is an illustrative diagram showing a front perspective view of a new side plank exercise apparatus in accordance with this disclosure.
Figure 13:
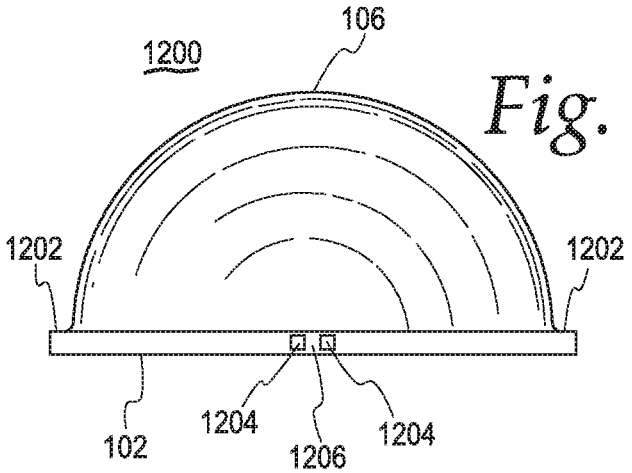
FIG. 13 is an illustrative diagram showing a front side view of a new side plank exercise apparatus in accordance with this disclosure.
Figure 14:
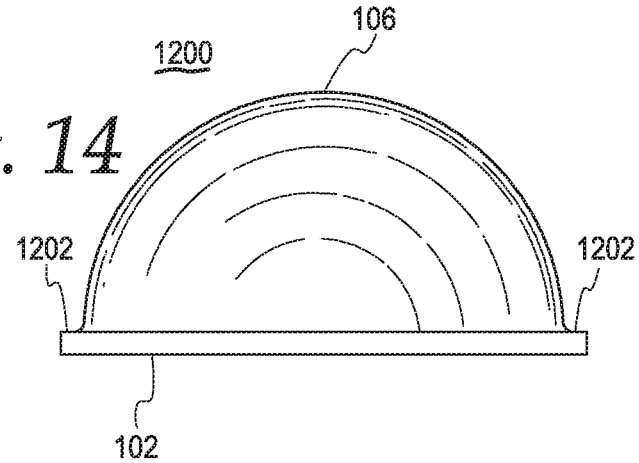
FIG. 14 is an illustrative diagram showing a rear side view of a new side plank exercise apparatus in accordance with this disclosure.

Referring now to FIG. 12, a front perspective view of a new side plank exercise device with an edge is shown and generally indicated at 1200. The new side plank exercise device 1200 incorporates an edge 1202 at it front end 101. The edge 1202 horizontally extends from the front end 101 outwardly. In one embodiment, the edge 1202 horizontally extends away from the spherical cap portion of the new side plank exercise device 1200 in 360° around the spherical portion. Side views of the new side plank exercise device 1200 are shown in FIGS. 13 and 14.

In a further implementation, the edge 1202 incorporates a strap attachment point for attaching a strap to the new side plank exercise device 1200. The attachment point includes an attachment cavity 1204 around a crossbar 1206. Accordingly, the attachment cavity 1204 exposes two holes on the surface of the edge 1202. The crossbar 1206 is an integral part of the side plank exercise device 1200. Alternatively, the crossbar 1206 is mounted to the side plank exercise device 1200 through, for example, welding, screws, etc. As used herein, the crossbar 1206 is said to be a part of the new side plank exercise device 1200. A strap can be inserted into the attachment cavity 1204 through of the two holes and goes out of the other hole. The strap then wraps around the crossbar 1206. The strap can then be used to move, secure and/or show the new side plank exercise device 1200. As used herein, the attachment cavity 1204 is said to receive the strap and the crossbar 1206.

Moreover, a carabiner can be attached to the crossbar 1206 while a strap is attached to the carabiner. The strap can also be attached to the crossbar 1206 by looping around it. In one implementation, the crossbar 1206 is made of molded plastic that is infused with fiberglass.

Figure 10:
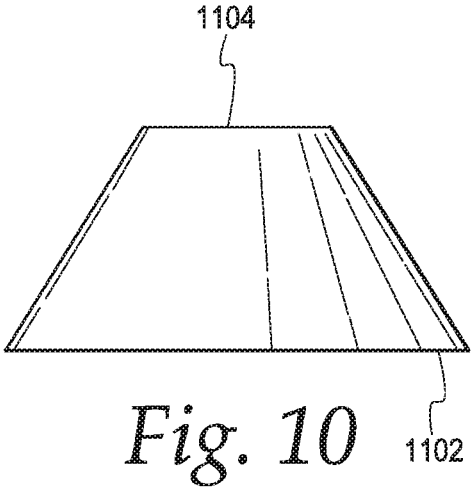
FIG. 10 is an illustrative diagram showing a bottom view of a new side plank exercise apparatus in accordance with this disclosure.
Figure 11:
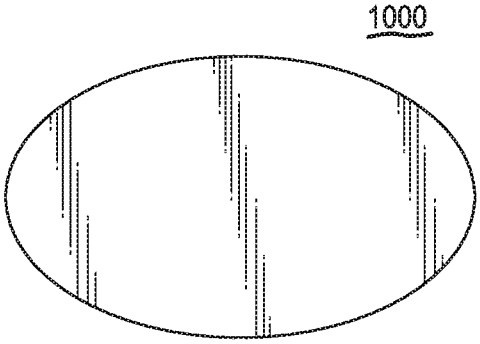
FIG. 11 is an illustrative diagram showing a side view of a new side plank exercise apparatus in accordance with this disclosure.

Obviously, many additional modifications and variations of the present disclosure are possible in light of the above teachings. Thus, it is to be understood that, within the scope of the appended claims, the disclosure may be practiced otherwise than is specifically described above. For example, the front surface edge 104 takes the shape of an oval. The bottom view of such an implementation is shown in FIG. 10 and generally indicated at 1000. In one implementation, the major axis of the oval is approximately parallel to the longitudinal direction of the recess 108. As an additional example, the new side plank device is constructed in the shape of a frustum. A side view of the new side plank device in the shape of a frustum is shown in FIG. 11 and includes a front end 1102 and a rear end 1104.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It should be recognized that the words "a" or "an" are intended to include both the singular and the plural. Conversely, any reference to plural elements shall, where appropriate, include the singular.

It is intended that the scope of the disclosure not be limited by the specification, but be defined by the claims set forth below. In addition, although narrow claims may be presented below, it should be recognized that the scope of this invention is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. A side plank exercise device comprising:

i. a front end having a front surface, said front surface being a cavitary surface and having a front edge, said cavitary surface surrounding a cavity, said front edge being circular or oval;

ii. two foot shaped recess supports disposed within said cavity, having outside walls forming parts of said cavitary surface and having two respective contours;

iii. a pair of recesses disposed within said two foot shaped recess supports respectively and adapted to receive a left side shoe and a right side shoe respectively; and iv. a rear end extended away from said front end, said rear end tapered from said front end.

2. The side plank exercise device of claim 1 wherein said contours are parallel to said front edge.

3. The side plank exercise device of claim 2 wherein said side plank exercise device is in the shape of a spherical cap or a cone.

4. The side plank exercise device of claim 3 wherein each recess within said pair of recesses incorporates a grip at a bottom surface of said recess.

5. The side plank exercise device of claim 4 wherein said grip includes a set of protruding lines or a set of protruding spherical caps.

6. The side plank exercise device of claim 5 wherein each recess within said pair of recesses has a depth of two inches.

7. The side plank exercise device of claim 5 wherein each recess within said pair of recesses is uneven in depth.

8. The side plank exercise device of claim 3 wherein said side plank exercise device is in the shape of a hemisphere.

9. The side plank exercise device of claim 2 wherein each recess within said pair of recesses has a depth of two inches.

10. The side plank exercise device of claim 2 wherein each recess within said pair of recesses is uneven in depth.

11. A side plank exercise device comprising:

i. a front end having a front surface, said front surface being a cavitary surface and having a front edge, said cavitary surface surrounding a cavity, said front edge being circular or oval;

ii. two foot shaped recess supports disposed within said cavity, having outside walls forming parts of said cavitary surface and having two respective contours;

iii. a pair of recesses disposed within said two foot shaped recess supports respectively and adapted to receive a left side shoe and a right side shoe respectively; and iv. a rear end extended away from said front end wherein said side plank exercise device is in the shape of a frustum or a cylinder.

12. The side plank exercise device of claim 11 wherein said contours are parallel to said front edge.

13. The side plank exercise device of claim 12 wherein each recess within said pair of recesses incorporates a grip at a bottom surface of said recess.

14. The side plank exercise device of claim 13 wherein said grip includes a set of protruding lines or a set of protruding spherical caps.

15. The side plank exercise device of claim 14 wherein each recess within said pair of recesses has a depth of two inches.

16. The side plank exercise device of claim 14 wherein each recess within said pair of recesses is uneven in depth.

17. The side plank exercise device of claim 12 wherein each recess within said pair of recesses has a depth of two inches.

18. The side plank exercise device of claim 12 wherein each recess within said pair of recesses is uneven in depth.

19. The side plank exercise device of claim 11 further comprising an edge extending away from said front end outwardly.

20. The side plank exercise device of claim 19 further comprising an attachment point, said attachment point having a crossbar in said edge and an attachment cavity receiving said crossbar and exposing two holes on a surface of said edge.

* * * * *